US007917969B2

(12) United States Patent
Iwasiuk

(10) Patent No.: US 7,917,969 B2
(45) Date of Patent: Apr. 5, 2011

(54) FIRE SAFETY ESCAPE DEVICE

(76) Inventor: George Iwasiuk, West Islip, NY (US)

( * ) Notice: Subject to any disclaimer, the term of this patent is extended or adjusted under 35 U.S.C. 154(b) by 246 days.

(21) Appl. No.: 11/400,963

(22) Filed: Apr. 10, 2006

(65) Prior Publication Data

US 2007/0234464 A1 Oct. 11, 2007

(51) Int. Cl.
*A41D 13/00* (2006.01)

(52) U.S. Cl. ..... 2/69

(58) Field of Classification Search ..... 2/456, 458, 2/69, 69.5, 80, 81, 903, 904; 182/3–7
See application file for complete search history.

(56) References Cited

U.S. PATENT DOCUMENTS

| | | | | | |
|---|---|---|---|---|---|
| 919,159 | A | * | 4/1909 | Goddard | 5/628 |
| 1,128,025 | A | | 2/1915 | Mass | |
| 1,351,734 | A | | 9/1920 | Barrington | |
| 1,711,167 | A | * | 4/1929 | Blake | 182/230 |
| 2,227,751 | A | * | 1/1941 | Idelman | 2/69.5 |
| 2,432,741 | A | | 12/1947 | Frankel | |
| 2,899,692 | A | * | 8/1959 | Finken | 5/628 |
| 4,124,908 | A | * | 11/1978 | Burns et al. | 5/628 |
| 4,287,963 | A | | 9/1981 | Coxsey | |
| 4,550,801 | A | | 11/1985 | Forrest | |
| 4,671,384 | A | | 6/1987 | Sing | |
| 4,790,040 | A | * | 12/1988 | Grilliot et al. | 5/413 R |
| 4,897,885 | A | * | 2/1990 | Lunt | 2/69.5 |
| 4,919,231 | A | | 4/1990 | Klokseth | |
| 4,970,739 | A | * | 11/1990 | Bradford | 5/625 |
| 5,050,254 | A | * | 9/1991 | Murphy | 5/625 |
| 5,189,746 | A | * | 3/1993 | Horie | 5/627 |
| 5,243,724 | A | * | 9/1993 | Barnes | 5/482 |
| 5,289,959 | A | * | 3/1994 | Beeley et al. | 224/160 |
| 5,678,739 | A | * | 10/1997 | Darling et al. | 224/160 |
| 5,729,850 | A | * | 3/1998 | Eskeli | 5/621 |
| 6,199,232 | B1 | * | 3/2001 | Kocivar | 5/502 |
| 6,880,671 | B2 | | 4/2005 | Raby | |

* cited by examiner

*Primary Examiner* — Tejash Patel
(74) *Attorney, Agent, or Firm* — Scully, Scott, Murphy & Presser, P.C.

(57) ABSTRACT

A fire-resistant pouch to accommodate a child comprising a head end, two leg ends, a back end with solid support adapted to upstand the child, an interior harness in the interior portion and a lock harness clip of the back end, and two elongate sides, wherein the elongate sides and the head end can be folded over the child and secured to form a front end, thereby enclosing the child in the fire-resistant pouch.

20 Claims, 5 Drawing Sheets

FIRE SAFETY ESCAPE DEVICE

BACKGROUND OF THE INVENTION

1. Field of Invention

The present invention relates to fire safety and, more particularly, to a fire-resistant pouch for children, and a fire escape device comprising the fire-resistant pouch.

2. Description of Related Art

There are a variety of fire escape devices for multi-level buildings and dwellings, and these range from complex elevators to folding ladders, and simple harnesses for lowering people to the ground. Many of the latter devices utilize a harness attached to a rope that is wound about a pulley mechanism inside the dwelling.

Examples of such devices may be seen in U.S. Pat. Nos. 1,128,025; 1,351,734; 2,432,741; 4,287,963, 4,550,801; 4,671,384; 4,919,231 and 6,880,671. However, none of these patents disclose devices that can secure a child securely.

Consequently, there is a need for an improved fire escape device that addresses the problems faced by the above prior art devices.

BRIEF SUMMARY OF THE INVENTION

One aspect of the invention relates to a fire-resistant pouch to accommodate a child comprising a head end, two leg ends, a back end with solid support adapted to upstand the child, an interior harness and a lock harness clip in the interior portion of the back end, and two elongate sides, wherein the elongate sides and the head end can be folded over the child and secured to form a front end, thereby enclosing the child in the fire-resistant pouch.

In one embodiment, the fire resistant pouch further comprises at least two connecting elements on the back end of the fire resistant pouch, wherein the connecting elements can be adapted to be connected to straps or a tether.

In another embodiment, the fire-resistant pouch comprises a fire-resistant fabric that is compliant with the Minimum Thermal Protective Performance Ratings established by the NFPA (National Fire Protection Agency).

In another embodiment, the head end includes a hook and loop fastener locking flap capable of covering the child's head and the fastening element.

In another embodiment, the head end further comprises one or more top hook and loop fastener locking flap connectors and one or more bottom hook and loop fastener locking flap connectors, wherein the one or more top hook and loop fastener locking flap connectors can connect to the one or more bottom hook and loop fastener locking flap connectors, thereby covering the child's head.

Another aspect of the invention relates to a fire escape device comprising:

(a) the fire-resistant pouch described above; and (b) a tether with one end attached to the connecting elements of the pouch via a connecting ring for lowering the fire-resistant pouch manually to the ground.

In another embodiment, the fire escape device further comprises a lowering device attached to a second end of the tether. The lowering device is preferably a descent control fixture anchored to a building at a fire escape point.

In another embodiment, the tether of the fire escape device is a rope which is of sufficient length for lowering the fire-resistant pouch to the ground and which can be anchored inside the building.

In yet another embodiment, the fire-escape device further comprises one or more supplemental tethers, wherein the tether and supplemental tethers are capable of attaching to each other, thereby extending the total length of the tether.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE INVENTION

Figure 1:
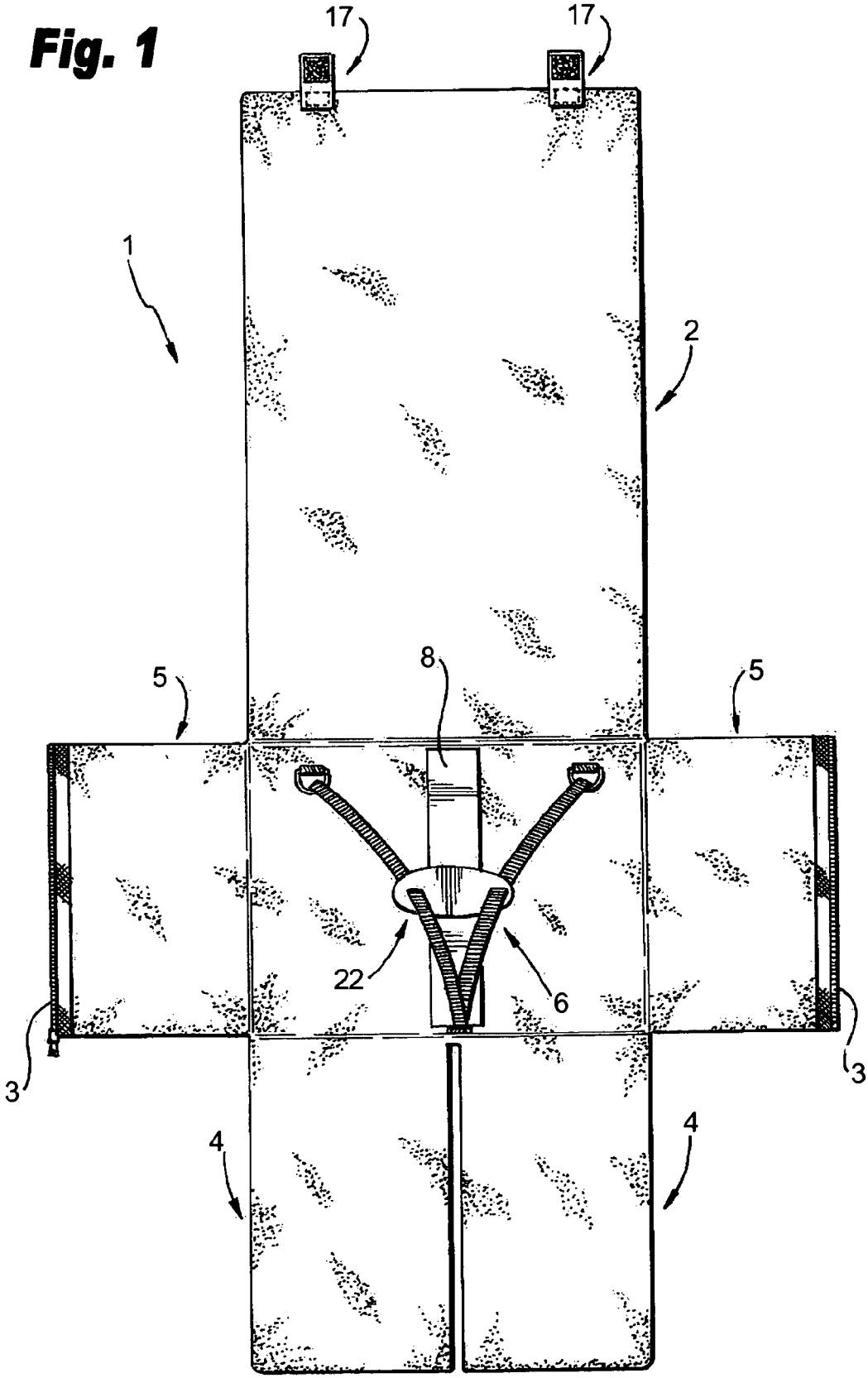
FIG. 1 is a front perspective of the fire resistant pouch (1) for children according to one embodiment of the present invention. The two elongate sides (5) and head end hook and loop fastener locking flap (2) are open, thereby exposing the inner harness (6) and a lock harness clip (22) for holding the child.

The invention provides a fire-resistant pouch (1) and a fire escape device comprising the fire-resistant pouch (1).

The fire-resistant pouch (1) can accommodate a child, but can also accommodate handicapped people, pets or inanimate objects. The fire-resistant pouch (1) comprising a head end (2), two leg ends (4), a back end (16) with solid support (8) adapted to upstand the child, an interior harness (6) and a lock harness clip (22) in the interior position of the back end (16), and two elongate sides (5), wherein the elongate sides (5) and the head end (2) can be folded over the child and secured to form a front end (15), thereby enclosing the child in the fire-resistant pouch.

Figure 2:
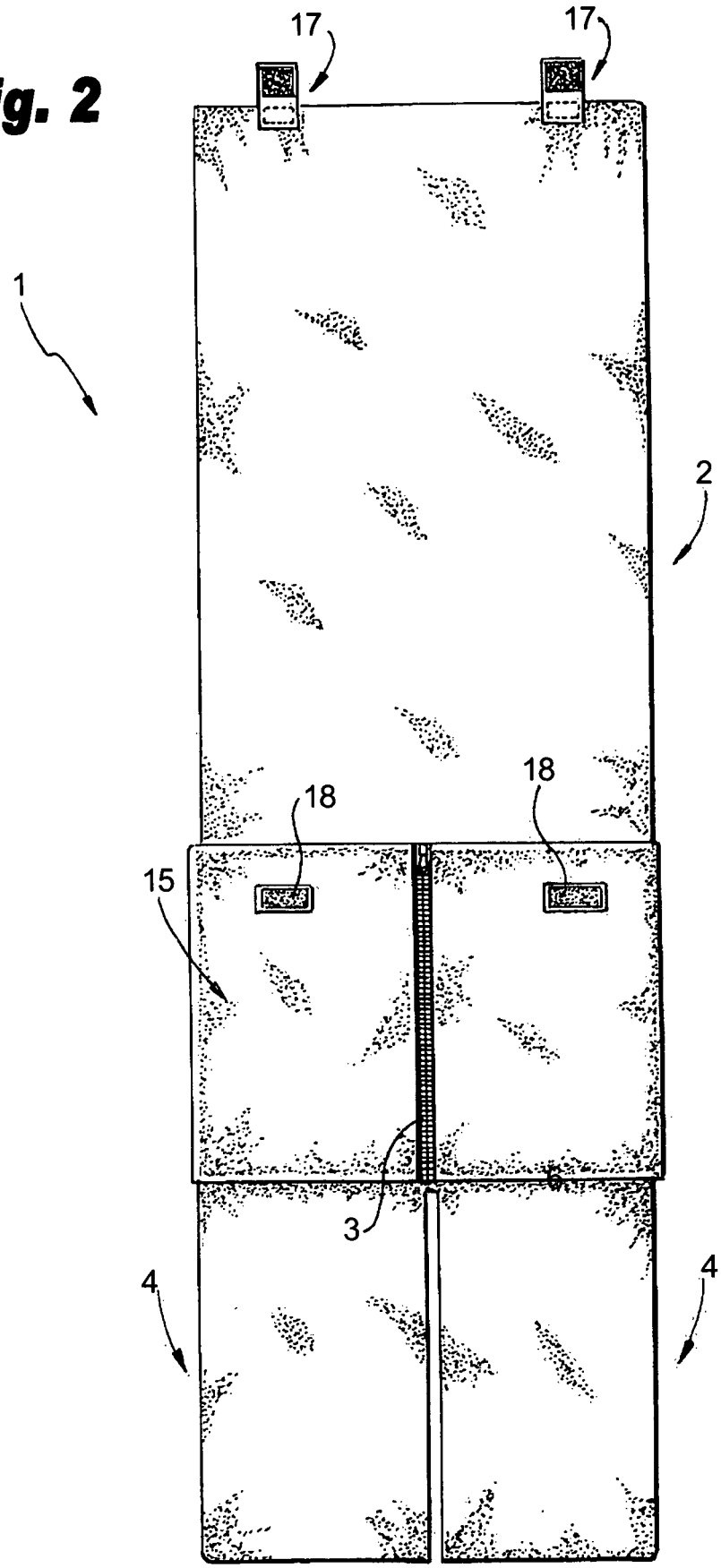
FIG. 2 is a front perspective of the fire resistant pouch (1) for children according to one embodiment of the present invention. The two elongate sides (5) are closed.

In another embodiment, as shown in FIG. 2, the elongate sides (5) of the fire resistant pouch (1) are sealed together by a fastening element (3), preferably a zipper. In addition, the head end (2) can be a hook and loop fastener locking flap. The embodiment as shown in FIG. 2 also shows two top hook and loop fastener locking flap connectors (17) capable of connecting to two bottom hook and loop fastener locking flap connectors (18), thereby covering the child's head. The hook and loop fastener may be, for example, a VELCRO® fastener, generally depicted in FIGS. 1-3 as locking flap connectors 17 and 18.

Preferably the fire-resistant pouch (1) and a fire escape device are portable and can be used at any of a variety of predetermined windows or other evacuation points. The fire-resistant pouch (1) is preferably used to secure children, and can also be used to hold and support handicapped people, pets and inanimate objects.

Figure 4:
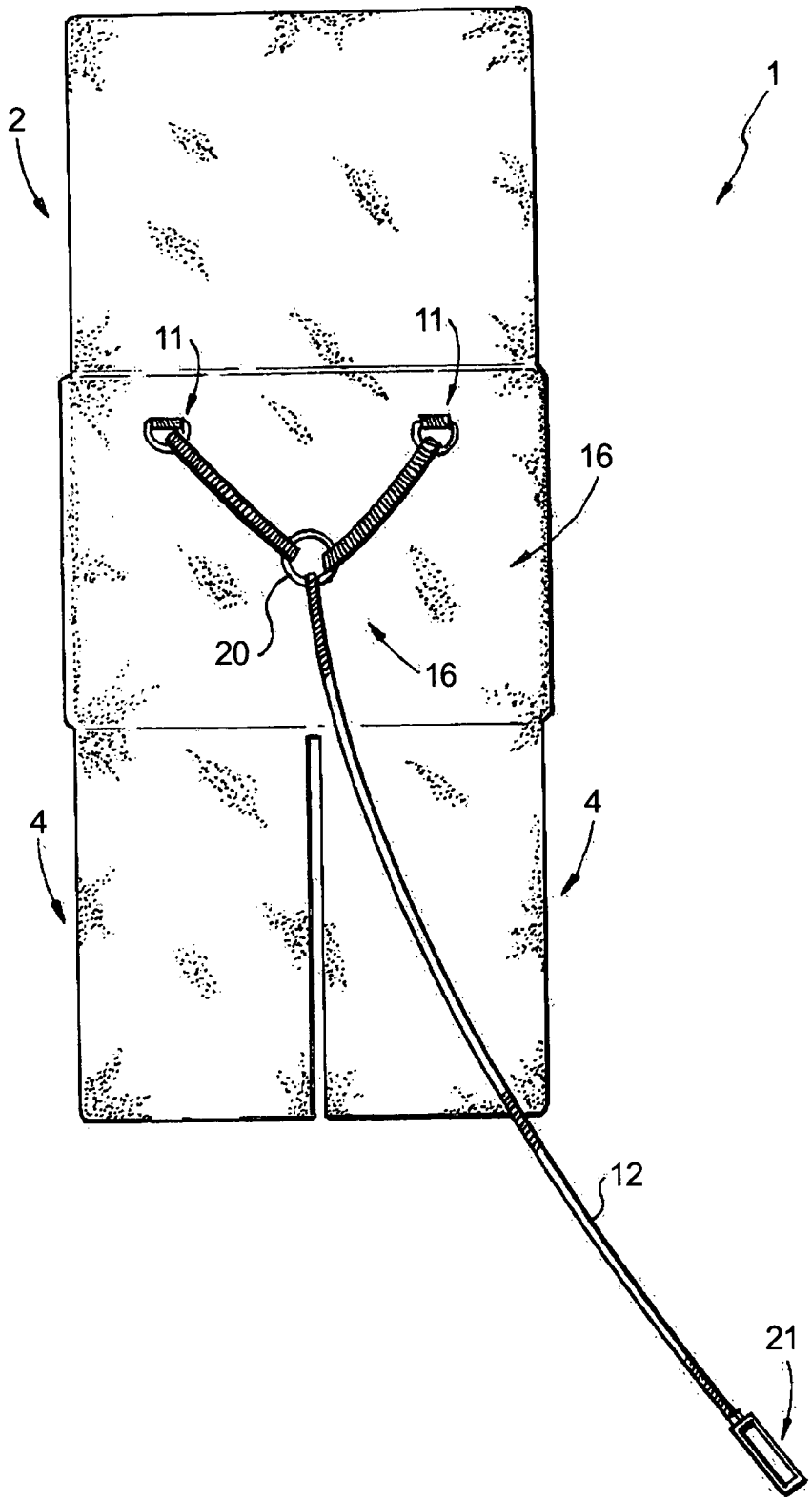
FIG. 4 is a back perspective of the fire-resistant pouch (1) for children according to one embodiment of the present invention. The two elongate sides (5) and the head end hook and loop fastener locking flap (2) are closed, thereby sealing the child. A tether (12) is attached to two connecting elements (11) on the fire-resistant pouch (1).

In another embodiment, as shown in FIG. 4, the fire-resistant pouch (1) can be attached to a tether (12), wherein one end of the tether is attached to a connecting ring (20), which is attached to at least two connecting elements (11) of the pouch, for lowering the fire-resistant pouch manually to the ground. The tether (12) can have a carabiner (21), which can attach to additional tethers or an object in a building.

Figure 5:
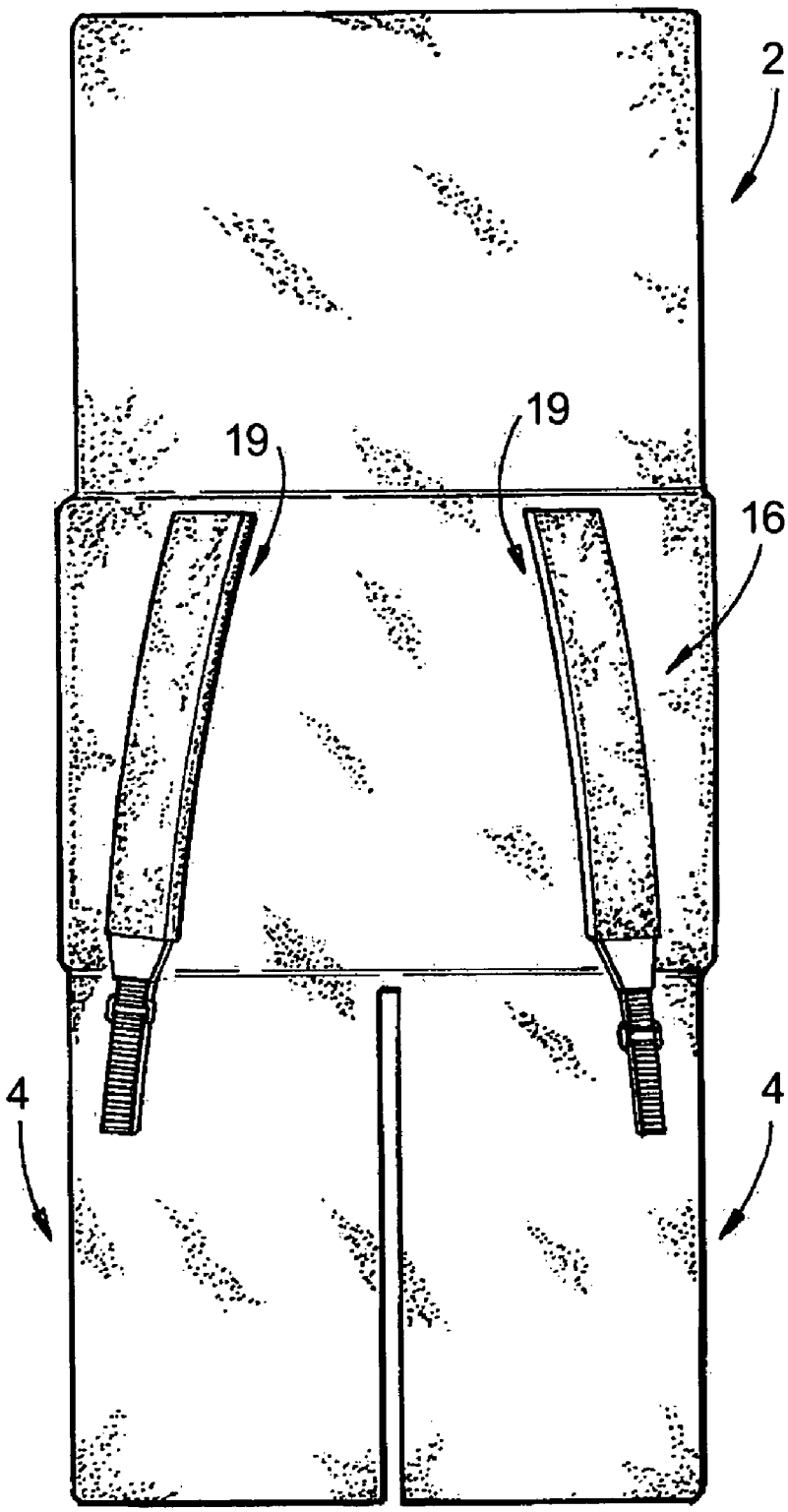
FIG. 5 is a back perspective of the fire-resistant pouch (1) for children according to one embodiment of the present invention. The two elongate sides (5) and the head end Velcro hook and loop fastener locking flap (2) are closed, thereby sealing the child. Two straps (19) are attached to the back end (16) of the fire-resistant pouch (1).

In one embodiment, as shown in FIG. 5, the fire-resistant pouch (1) can be attached to shoulder straps (19) so that an individual can carry the fire-resistant pouch (1) away from fire and to safety.

Preferably, the fire-resistant pouch (1) and fire escape device offers maximum strength, security and protection against heat and flames. Preferably, the child in the fire-resistant pouch (1) is fully enclosed by the fire-resistant material when in use for carrying the child. The connecting elements (11) that attach to the variable tether (12) or outer harness can be attached to the fire-resistant pouch (1) in various locations. For instance, the connecting elements (11) can be attached at positions on the front end (15) or the back end (16) so that one could attach a tether (12) for lowering the fire-resistant pouch. Various kinds of tethers can be used, such as tethers known to one skilled in the art, which are sufficient for lowering the fire-resistant pouch (1) to safety. Alternatively, one can attach shoulder straps (19) onto the back end (16) to carry the fire-resistant pouch (1). Various kinds of harnesses can be used, which are known to one skilled in the art, that would be sufficient for enabling a person to carry the fire-resistant pouch.

Figure 3:
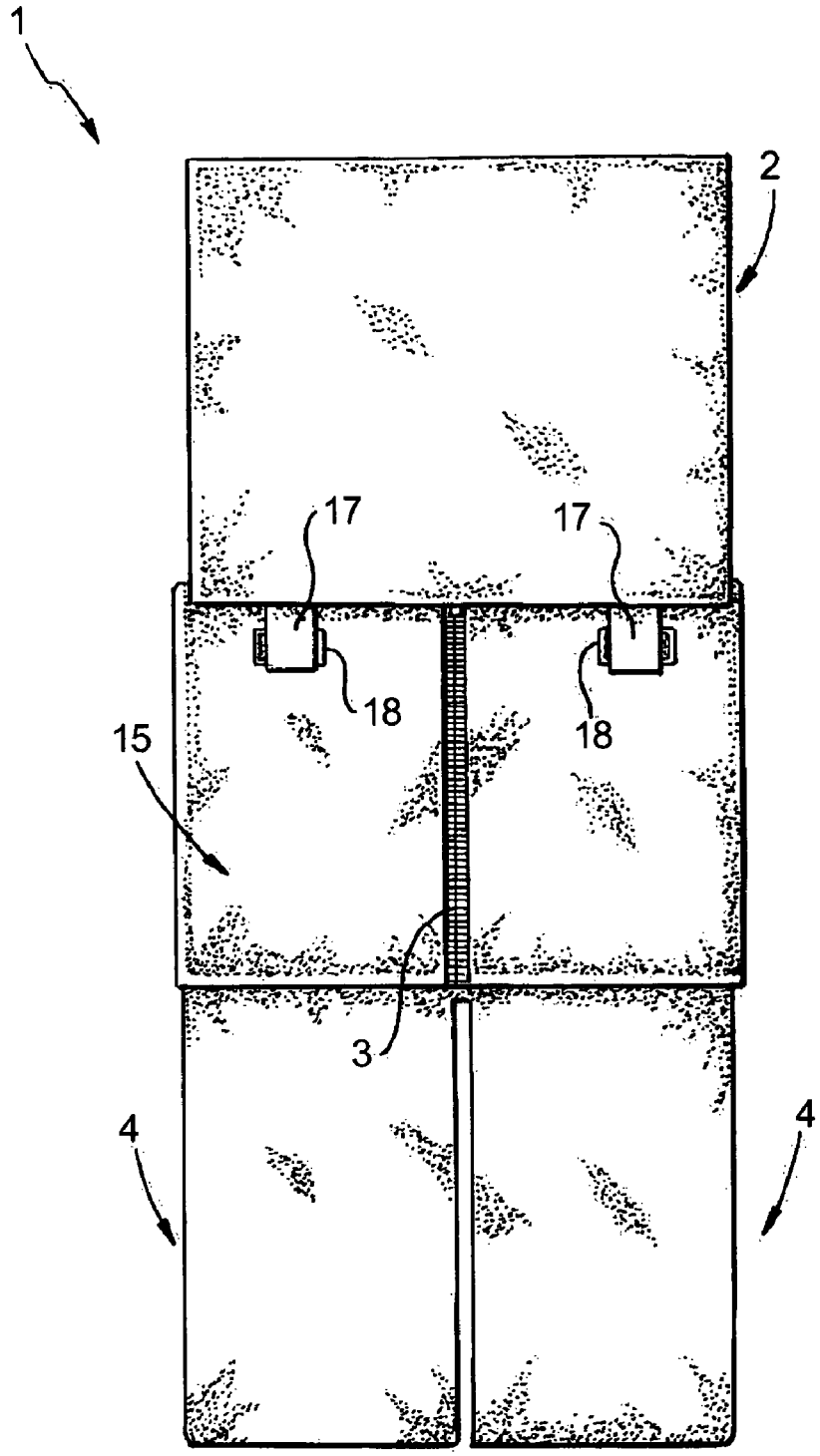
FIG. 3 is a front perspective of the fire resistant pouch (1) for children according to one embodiment of the present invention. The two elongate sides (5) and head end hook and loop fastener locking flap (2) are closed, thereby sealing the child.

In the fire escape device, one can manually by hand lower the fire-resistant pouch (1) by the tether (12). In one example, as shown in FIG. 3, one end of the tether (12) is connected to two connecting elements (11). The end of the tether has a latch that can be hooked onto a person or object inside a building when lowering the fire-resistant pouch.

Alternatively, the fire escape device can include a lowering apparatus for lowering the fire-resistant pouch (1) by the tether (12). Any lowering device known in the art, which is capable of lowing the fire-resistant pouch, can be used. Non-limiting examples of lowering devices are disclosed in U.S. Pat. Nos. 4,287,963, 4,550,801, 4,919,213, 4,671,384 and 6,880,671. Typically, the lowering device can be attached inside a window or to a terrace.

The length of the tether (12) can be, for example, about 10' long, and additional tethers (12) that are about 10' long can be attached to enable a person to lower the fire-resistant pouch from greater heights in a building.

Having now fully set forth a detailed example and certain modifications incorporating the concept underlying the present invention, various other modifications will obviously occur to those skilled in the art upon becoming familiar with the underlying concept. It is to be understood, therefore, that within the scope of the appended claims, the invention may be practiced otherwise than as specifically set forth in the appended claims.

What is claimed is:

1. A fire-resistant pouch to accommodate a child, comprising:

a head end, two leg ends, a back end having a longitudinally extending solid support for upstanding the child;

an interior harness including at least two inner straps, each of the at least two inner straps having a first end each coupled to corresponding upper connecting elements attached to the back end, the upper connecting elements being in spaced relation to each other, each of the at least two inner straps having a second end coupled at a lower common location on the back end between the upper connecting elements, a lock harness clip in the interior portion of the back end coupled to each of the at least two inner straps, the solid support of the back end being located at least partially between the upper connecting elements, and two elongate sides, wherein the elongate sides and the head end can be folded over the child and secured to form a front end enclosing the child in the fire-resistant pouch;

a carrying device fixedly attached to the pouch at least one location for lifting and lowering the pouch; and an outer-harness attached to the pouch for passing over the shoulders of a person to locate the respective fire-resistant pouch in front or in back of the person when the fire resistant pouch is in use, the outer-harness including at least two outer straps in spaced relation to each other, each of the at least two outer straps having an upper end connected to the back end, and each of the at least two outer straps having a lower end adjustably connected to the two leg ends, respectively.

2. The fire resistant pouch according to claim 1, further comprising at least two connecting elements on the back end of the fire resistant pouch, wherein the connecting elements are connected to straps or a tether.

3. The fire-resistant pouch according to claim 1, wherein the fire-resistant pouch comprises a fire-resistant fabric that is compliant with the Minimum Thermal Protective Performance Ratings established by the NFPA.

4. The fire resistant pouch according to claim 1, wherein the elongate sides are sealed together by a fastening element.

5. The fire resistant pouch according to claim 4, wherein the head end includes a hook and loop fastener locking flap covering the child's head.

6. The fire resistant pouch according to claim 5, wherein the hook and loop fastener locking flap top further comprises one or more top hook and loop fastener locking flap connectors and one or more bottom hook and loop fastener locking flap connectors, wherein the one or more top hook and loop fastener locking flap connectors can connect to the one or more bottom hook and loop fastener locking flap connectors, thereby covering the child's head.

7. The fire resistant pouch according to claim 4, wherein the fastening element is a zipper.

8. The fire resistant pouch according to claim 1, further comprising a tether with one end attached to the connecting elements of the pouch via a connecting ring for lowering the fire-resistant pouch manually to the ground.

9. The fire resistant pouch according to claim 8, further comprising a lowering device attached to a second end of the tether.

10. A fire resistant pouch according to claim 9, wherein the lowering device is a descent control fixture anchored to a building at a fire escape point.

11. The fire resistant pouch according to claim 8, wherein the tether is a rope which is of sufficient length for lowering the fire-resistant pouch to the ground and which can be anchored inside the building.

12. The fire resistant pouch according to claim 8, further comprising one or more supplemental tethers, wherein the tether and supplemental tethers are capable of attaching to each other, thereby extending the total length of the tether.

13. The fire resistant pouch according to claim 1, wherein the interior harness is non adjustable.

14. The fire resistant pouch according to claim 13, wherein the interior harness forms a closed loop.

15. The fire resistant pouch according to claim 1, wherein the interior harness is affixed to the interior portion of the back end.

16. The fire resistant pouch according to claim 1, wherein the carrying device is attached to the back end of the pouch.

17. The fire resistant pouch according to claim 1, wherein the solid support of the back end is located along a substantially central longitudinal axis of the back end.

18. The fire resistant pouch according to claim 7, wherein the child is enclosed in the pouch when the zipper is zipped.

19. A method for providing a fire-resistant pouch to accommodate a child, comprising:

upstanding a child using a head end, two leg ends, a back end having a longitudinally extending solid support;

providing an interior harness including at least two inner straps;

coupling a first end of each of the at least two inner straps to corresponding upper connecting elements attached to the back end, the upper connecting elements being in spaced relation to each other;

coupling a second end of each of the at least two inner straps at a lower common location on the back end between the upper connecting elements;

coupling a lock harness clip to each of the at least two inner straps in the interior portion of the back end;

locating the solid support of the back end at least partially between the upper connecting elements;

providing two elongate sides;

folding the elongate sides and the head end over the child;

securing the elongated sides and the head end to form a front end enclosing the child in the fire-resistant pouch;

fixedly attaching a carrying device to the pouch at least one location for lifting and lowering the pouch;

attaching an outer-harness to the pouch for passing over the shoulders of a person to locate the respective fire-resistant pouch in front or in back of the person when the fire resistant pouch is in use, the outer-harness including at least two outer straps in spaced relation to each other; and connecting an upper end of each of the at least two outer straps to the back end and adjustably connecting a lower end of each of the at least two outer straps to the two leg ends, respectively.

20. The method according to claim 19, further comprising:

sealing together the elongate sides using a fastening element including a zipper; and enclosing the child in the pouch when the zipper is zipped.

* * * * *